US008604770B2

(12) United States Patent
Oshima

(10) Patent No.: US 8,604,770 B2
(45) Date of Patent: Dec. 10, 2013

(54) LOAD DRIVE DEVICE FOR EXPANDING RANGE OF OUTPUT POWER

(75) Inventor: Kazunori Oshima, Tokyo (JP)

(73) Assignee: TDK-Lambda Corporation, Tokyo (JP)

( * ) Notice: Subject to any disclaimer, the term of this patent is extended or adjusted under 35 U.S.C. 154(b) by 260 days.

(21) Appl. No.: 13/166,944

(22) Filed: Jun. 23, 2011

(65) Prior Publication Data

US 2011/0316510 A1 Dec. 29, 2011

(30) Foreign Application Priority Data

Jun. 23, 2010 (JP) ..... 2010-142901

(51) Int. Cl.
*G05F 1/00* (2006.01)

(52) U.S. Cl.
USPC ..... 323/285; 323/282

(58) Field of Classification Search
USPC ..... 323/222–225, 241–243, 271, 281–285, 323/288, 322
See application file for complete search history.

(56) References Cited

U.S. PATENT DOCUMENTS

| | | | | |
|---|---|---|---|---|
| 6,696,821 | B2 * | 2/2004 | Haraguchi et al. | 323/222 |
| 7,098,640 | B2 * | 8/2006 | Brown | 323/283 |
| 7,358,706 | B2 * | 4/2008 | Lys | 323/222 |
| 7,589,506 | B2 * | 9/2009 | Brown | 323/271 |
| 7,782,038 | B2 * | 8/2010 | Klein | 323/285 |
| 7,990,106 | B2 * | 8/2011 | Hussain et al. | 320/128 |
| 8,169,207 | B2 * | 5/2012 | Omi | 323/285 |
| 2003/0020437 | A1 * | 1/2003 | Kanamori | 323/222 |
| 2005/0168198 | A1 * | 8/2005 | Maksimovic et al. | 323/222 |
| 2006/0145670 | A1 * | 7/2006 | Zhou et al. | 323/222 |
| 2009/0015231 | A1 * | 1/2009 | Wu et al. | 323/288 |
| 2009/0026977 | A1 * | 1/2009 | Omi | 315/294 |
| 2011/0316508 | A1 * | 12/2011 | Cheng et al. | 323/282 |

FOREIGN PATENT DOCUMENTS

JP 2009-033090 A 2/2009

* cited by examiner

*Primary Examiner* — Timothy J Dole
*Assistant Examiner* — Yusef Ahmed
(74) *Attorney, Agent, or Firm* — Fox Rothschild, LLP; Robert J. Sacco

(57) ABSTRACT

A load drive device capable of expanding a range of an output power by improving a linearity thereof when the output power varies. This device includes an output circuit (14) for supplying an electric power to an LED (10), a feedback circuit (28) for turning on or off the electric power supplied to the LED (10) according to a duty ratio of a burst signal to control the electric power and generating a control value for controlling the LED (10) based on an A/D-converted value obtained by detecting an output current (Iout) to the LED (10) to send out the control value to the output circuit when the supply of the electric power is in an on-state, a burst signal previous value correcting circuit (64) for correcting a presently generated control value (y) based on the A/D-converted value (V) and the previous control value (x) which are generated every cycle of the burst signal, and a duty ratio determination circuit (66) for allowing the burst signal previous value correcting circuit (64) to operate upon determining that the duty ratio of the burst signal goes above or below a reference value.

12 Claims, 6 Drawing Sheets

| Threshold's Image of Previous A/D-Converted Value V | Processing Condition | Processing Formula |
|---|---|---|
| TH1 ———— | V > TH1 | y = x-1 |
| | V = TH1 | y = x |
| | TH1 > V | y = x+1 |

FIG.4

| Threshold's Image of Previous A/D-Converted Value V | Processing Condition | Processing Formula |
|---|---|---|
| TH2−1<br>TH2−2 | V ≧ TH2−1 | y = x−1 |
| | TH2−1 > V ≧ TH2−2 | y = x |
| | TH2−2 > V | y = x+1 |

FIG.5

| Threshold's Image of Previous A/D-Converted Value V | Processing Condition | Processing Formula |
|---|---|---|
| TH3−1<br>TH3−2<br>TH3−3<br>TH3−4 | V ≧ TH3−1 | y = x−2 |
| | TH3−1 > V ≧ TH3−2 | y = x−1 |
| | TH3−2 > V ≧ TH3−3 | y = x |
| | TH3−3 > V ≧ TH3−4 | y = x+1 |
| | TH3−4 > V | y = x+2 |

| Threshold's Image of Previous A/D-Converted Value V | Processing Condition | Processing Formula |
|---|---|---|
| TH4-1<br>TH4-3<br>TH4-2 | $V \geqq TH4-1$ | $y=(TH_{4-3}-V)\div\frac{V-V_{-1}}{x-x_{-1}}+x$ |
| | $TH4-1>V \geqq TH4-2$ | $y = x$ |
| | $TH4-2>V$ | $y=(TH_{4-3}-V)\div\frac{V-V_{-1}}{x-x_{-1}}+x$ |

LOAD DRIVE DEVICE FOR EXPANDING RANGE OF OUTPUT POWER

CROSS REFERENCE TO RELATED APPLICATIONS

This application claims the benefit of Japanese Patent Application Serial No. 2010-142901, entitled "LOAD DRIVE DEVICE", filed Jun. 23, 2010, which is herein incorporated by reference in its entirety.

BACKGROUND OF INVENTION

1. Field of the Invention

The present invention relates to a load drive device for driving constant load devices, such as LEDs (Light Emitting Diodes), electric lamps, motors or the like that have little or no abrupt load variations, particularly to a load drive device suitable for use in a power control circuit aimed at expanding a power control range.

2. Description of the Related Art

There has been disclosed, for example, in Japanese Unexamined Patent Application Publication No. 2009-33090, a load drive device comprising a converter performing PWM (Pulse Width Modulation) control according to a power control signal input to thereby adjust powers of loads. As an example of such a load drive device, FIG. 8 shows a conventional example of a light-emitting element drive device whose load comprises a plurality of series-connected LEDs 10.

In FIG. 8, numerical symbol 12 denotes a DC power supply, and numerical symbol 14 denotes a converter circuit for boosting an input voltage Vin from the DC power supply 12 to a DC output voltage Vout. An output terminal of the converter circuit 14 is connected to a series circuit of the LEDs 10 and a shunt resistor 16 serving as a current detector. The converter circuit 14 is composed of a choke coil 20, a main switching element 22 such as a MOSFET or the like, a diode 24 and a capacitor 26. The converter circuit 14 allows the input voltage Vin to be applied to the choke coil 20 when the main switching element 22 is turned on, thereby allowing an electric energy to be stored in the choke coil 20. When the main switching element 22 has been turned off, the electric energy stored so far in the choke coil 20 and an electric energy from the DC power supply 12 are sent out to the capacitor 26 on an output side, through the diode 24, thus allowing the output voltage Vout higher than the input voltage Vin to be supplied to the LEDs 10.

Meanwhile, a feedback circuit 28 for performing constant current control of the LEDs 10, comprises: an error amplifier 32 for comparing a voltage of a current detection signal of the LEDs 10 detected through the shunt resistor 16 with a reference voltage from a reference voltage source 30 and performing error amplification; a phase compensation circuit 38 composed of a series circuit of a resistor 34 and a capacitor 36 that are connected between an output terminal of the error amplifier 32 and a ground line to prevent the oscillation of the error amplifier 32, and; an oscillation circuit 40 for generating a reference signal of a triangle waveform signal or a saw-tooth waveform signal; and a comparator 42 for supplying to a gate of the main switching element 22 the result of comparison of an error amplification signal from the error amplifier 32 with the reference signal from the oscillation circuit 40, as a pulse drive signal. Among these components, the oscillation circuit 40 and the comparator 42 make up a PWM (Pulse Width Modulation) circuit 44 for generating the pulse drive signal with a duty ratio corresponding to the voltage level of the error amplification signal.

Under a steady-state condition, a current flowing through the LEDs 10 is detected by means of the shunt resistor 16, and a current detected value from the shunt resistor 16 is then compared with the reference voltage by the error amplifier 32, thus performing error amplification by the error amplifier 32. The error amplification signal thus generated is allowed to pass through the phase compensation circuit 38, and the pulse drive signal is generated based on the error amplification signal passing through the phase compensation circuit 38 in the PWM circuit 44, thereby allowing the main switching element 22 to be driven by the pulse drive signal, thus controlling the current flowing through the LEDs 10 to an objective output (current) value.

Numerical symbol 46 denotes a burst signal generation circuit for generating a burst signal based on a dimming signal supplied from external, said burst signal having a square waveform with a frequency lower than that of the pulse drive signal. The duty ratio of the burst signal is determined in accordance with an analog voltage level of the dimming signal, and the higher the voltage level of the dimming signal is, the smaller the duty ratio of the burst signal generated. Further, the dimming signal is output from the burst signal generation circuit 46 as it is, when the pulse-width modulated dimming signal other than a DC voltage, is input.

The PWM circuit 44 is allowed to output the pulse drive signal only when the burst signal is active. In other words, the PWM circuit 44 is configured so as not to output the pulse drive signal when the burst signal is inactive. For example, outputting the pulse drive signal stops by dropping a voltage input to an inverting input terminal of the comparator 42 or by stopping operation of the PWM circuit 44. Further, a switch element 48 is connected between the output terminal of the error amplifier 32 and the phase compensation circuit 38. The switch element 48 is turned on while the burst signal is active, but turned off while the burst signal is inactive. In this case, when the switch element 48 is turned off, the charges stored in the capacitor 36 of the phase compensation circuit 38 are held therein, thereby retaining the previous value of the error amplification value (a control value) caused by the previous operation of the burst signal, thus expanding the dimming range of the LEDs 10.

Conventionally, as the burst signal for PWM dimming becomes active, the switch element 48 is turned on, thereby ceasing to hold the previous value held by the capacitor 36 of the phase compensation circuit 38, and a controlling value Co input to the comparator 42 starts with the previous value.

FIG. 9 is a timing chart showing a correlation between an output current Iout detected through the shunt resistor 16 and the controlling value Co input to the comparator 42. Here, there are shown waveforms of the output current Iout and the controlling value Co in a case where the duty ratio of the burst signal is 40% (an upper row in FIG. 9), and in a case where the duty ratio of the burst signal is 5% (lower row in FIG. 9). As the duty ratio of the burst signal becomes small, a active period of the burst signal becomes short. Therefore, before the output current Iout reaches a objective value, the burst signal becomes inactive due to a delay of the phase compensation circuit 38 and delays of the choke coil 20 and the capacitor 26 that compose the converter circuit 14. In this way, the output current Iout at that time becomes lower than that output under steady state condition, thereby degrading the linearity of variable output power when decreasing a luminance of the LEDs 10 through dimming control. Therefore, conventionally, a lower limit of the output power supplied to the LEDs 10 has to be so limited that, for example, the duty ratio of the burst signal should be at least 10%.

SUMMARY OF THE INVENTION

In view of the aforementioned problem, it is an object of the present invention to provide a load drive device capable of improving the linearity of an output power supplied to a load when the output power varies to thereby enable the range of the output power to be expanded.

In order to achieve the aforementioned object, a load drive device of the present invention includes:

a converter circuit for controlling an electric power by performing PWM (Pulse Width Modulation) control, an output circuit for turning on or off the electric power supplied to a load according to a burst signal, a comparison circuit for comparing a duty cycle of said burst signal with a reference value, and a control value generating circuit for outputting a control value generated based on a detected value obtained by detecting a state of the load when a duty ratio of said burst signal is not smaller than said reference value, and a previous value correcting circuit for outputting said control value obtained by correcting a previous value of said control value when a duty ratio of said burst signal is smaller than said reference value, wherein said converter circuit determines a duty cycle of PWM based on said control value output from said control value generating circuit or said previous value correcting circuit.

Further, the previous value correcting circuit is configured to increase or decrease the previous value of the control value according to a result of comparison between the previous value of the detected value and one or more thresholds to generate a presently generated control value.

Alternatively, the previous value correcting circuit may determine a ratio between a variation in the previous value of the control value and a variation in the previous value of the detected value and then calculate a correction value by dividing a value, obtained by subtracting the previous value of the detected value from a target value, by the ratio, and then combine the correction value with the previous value of the control value to generate a presently generated control value.

Furthermore, the previous value correcting circuit may be equipped with a storage unit for storing the detected value obtained by the electric power control circuit in synchronization with the burst signal and further storing the control value output to the output circuit, and a calculator for calculating the corrected control value by way of input of the previous value of the detected value and the previous value of the control value which are read out of the storage unit and then outputting the calculated value to the output circuit.

In this case, it is desirable that there are provided a first A/D converter for digitalizing a voltage of the burst signal and a second A/D converter for digitalizing the detected value, and then the previous value correcting circuit imports these digitalized values to correct the control value.

Besides, the first and second A/D converters are desirably integrated into the previous value correcting circuit.

Moreover, the previous value correcting circuit may utilize one detected value obtained by the electric power control circuit as the previous value of the detected value.

Moreover, the previous value correcting circuit may calculate an average value of a plurality of the detected values obtained by the electric power control circuit to utilize the average value as the previous value of the detected value.

Further, the previous value correcting circuit may utilize one control value output to the output circuit as the previous value of the control value.

Alternatively, the previous value correcting circuit may calculate an average value of a plurality of the control values output to the output circuit to utilize the average value as the previous value of the control value.

According to the present invention set forth in a first aspect, when a duty ratio of a burst signal goes above or below to become, for example, smaller than the reference value, a previous value correcting circuit is allowed to operate, thereby making it possible to correct the presently generated control value to a value close to a value under steady-state condition in which the duty ratio of the burst signal does not go below the reference value, based on the previous value of the detected value and the previous value of a control value. Therefore, it is possible to improve the linearity of the variable output power when gradually reducing the output power supplied to a load, thus allowing the range of the output power to be expanded.

Further, according to the invention described in a second aspect, there can be calculated in each case the presently generated control value output in each cycle of the burst signal accordingly by combining a correction value varying depending on the result of comparison of the previous value of the detected value and one or more thresholds with the previous value of the control value.

Furthermore, there is obtained a ratio between a variation in the previous value of the control value and a variation in the previous value of the detected value, followed by calculating the correction value based on the ratio so that the previous value of the detected value reaches a target value, and then combining the correction value thus obtained with the previous control value, thereby obtaining the presently generated control value and allowing the presently generated control value to be further finely regulated.

Furthermore, the calculator reads out the previous value of the detected value and the previous value of the control value which are stored in advance in the storage unit, thereby enabling the control value presently generated to be calculated in each case.

Moreover, both the burst signal and the detected value which are to be imported into the previous value correcting circuit are digitalized, thereby enabling the process performed by the previous value correcting circuit to be practical and easy.

Besides, the first A/D converter and the second A/D converter are integrated into the previous value correcting circuit, thereby enabling a load drive device realized in a compact form to be provided.

Further, one detected value obtained by the electric power control circuit is utilized as the previous value of the detected value, thereby enabling the control value to be corrected by a simple process.

Furthermore, the average value of the plurality of the detected value obtained by the electric power control circuit is calculated to utilize the average value as the previous value of the control vale, thereby enabling the control value to be more precisely corrected.

Moreover, one control value output to the output circuit is utilized as the previous value of the control value, thereby enabling the control value to be corrected by a simple process.

Besides, the average value of the plurality of the control value output to the output circuit is calculated to utilize the average value as the previous value of the control value, thereby enabling the control value to be more precisely corrected.

BRIEF DESCRIPTION OF THE DRAWING

The invention will be more readily understood by reference to the following description, taken with the accompanying drawings, in which:

FIG. 4 is an explanatory figure showing other calculation examples of the presently generated control value of the embodiment of the present invention.

FIG. 5 is an explanatory figure showing yet other calculation examples of the present controlling value of the embodiment of the present invention.

DETAILED DESCRIPTION OF THE PREFERRED EMBODIMENT

Hereunder is a description of a preferred embodiment of the present invention with reference to the accompanying drawings. Note that the same numeral symbols are attached to parts the same as in those common with the conventional example and a description thereof is omitted to avoid duplicating the description.

Figure 1:
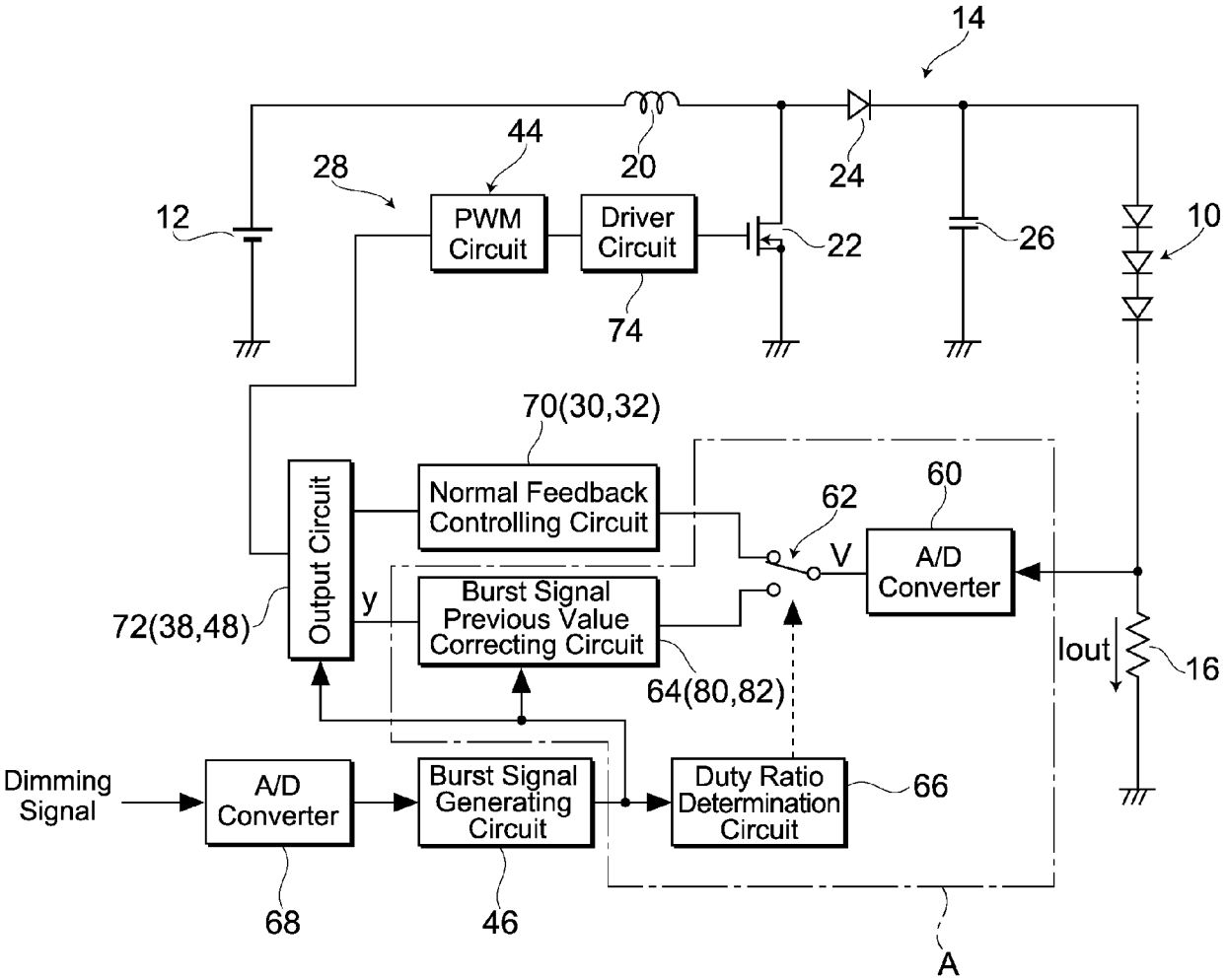
FIG. 1 is a circuit diagram showing a configuration of a load drive device of one embodiment of the present invention.

FIG. 1 shows an overall configuration of a load drive device in one embodiment of the present invention. In FIG. 1, in addition to the conventional device shown in FIG. 8, a configuration surrounded with a dashed line indicated by a symbol A includes an A/D converter 60, a changeover switch 62, a burst signal previous (control) value correcting circuit 64 and a duty ratio determination circuit 66. The A/D converter 60 is provided at the anterior stage of the burst signal previous value correcting circuit 64 due to the fact that a digital process is more practical and easier than an analogue process as described later. Further, since the burst signal previous value correcting circuit 64 imports a burst signal from a burst signal generating circuit 46, an A/D converter 68 is provided also at the anterior stage of the burst signal generating circuit 46 in order to digitize a dimming signal.

Figure 8:
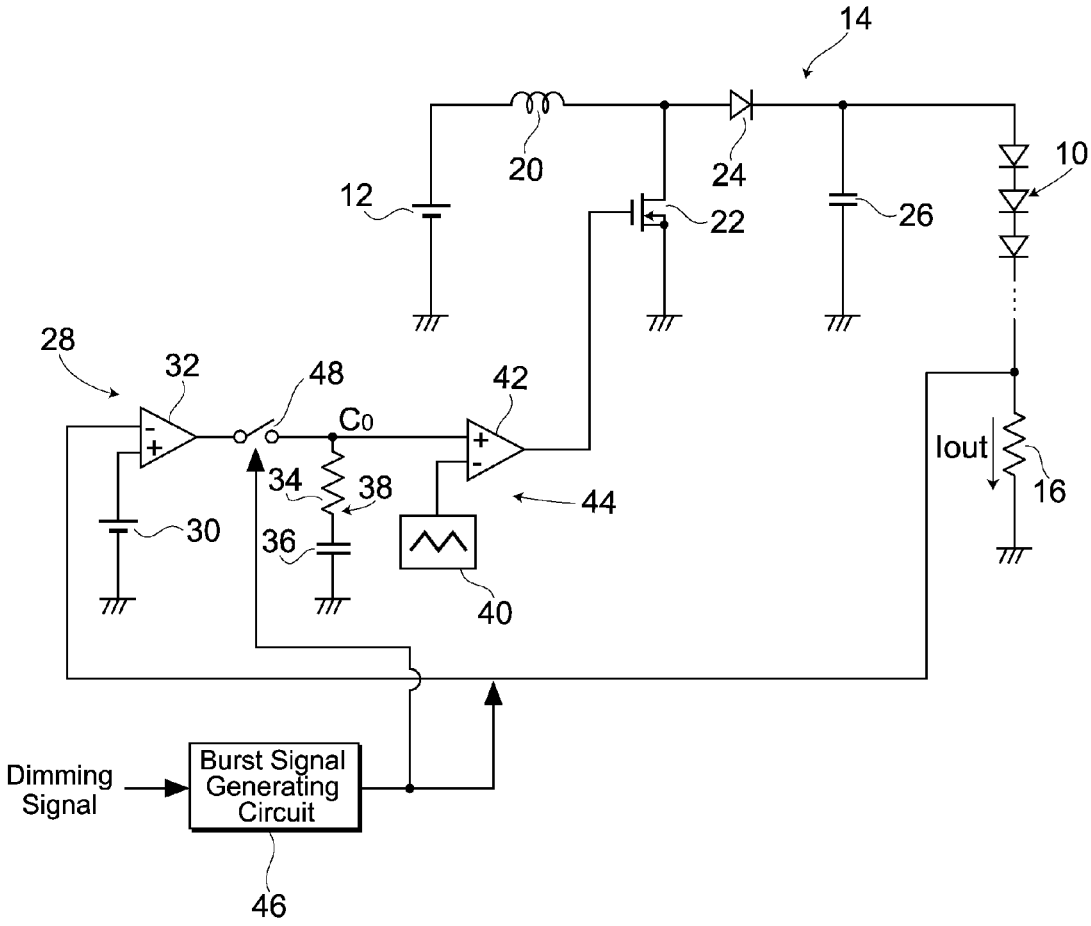
FIG.8 (RELATED ART)
FIG. 8 is a circuit diagram showing a configuration of a conventional load drive device.
Figure 9:
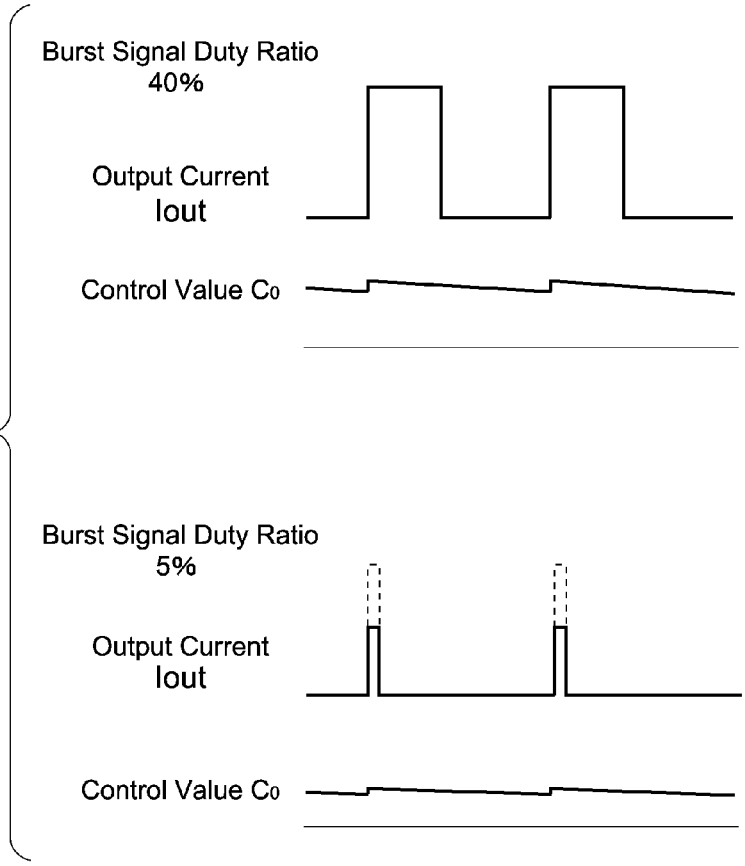
FIG.9 (RELATED ART)
FIG. 9 is a timing chart showing a correlation between an output current and a control value of the conventional load drive device.

The configuration of a feedback circuit 28 for performing constant current control of an LED 10 is substantially equal to that shown in FIG. 8. A normal feedback control circuit 70 shown in FIG. 1 corresponds to a configuration including the foregoing reference power supply 30 and the error amplifier 32. Further, an output circuit 72 corresponds to the configuration including the phase compensation circuit 38 and the switch element 48. Accordingly, the burst signal is supplied from the burst signal generating circuit 46 to the output circuit 72. A driver circuit 74 is connected between a PWM circuit 44 and a gate of a main switching element 22. This driver circuit 74 is intended to supply an output signal, as a pulse drive signal, from the PWM circuit 44 to the main switching element 22 in order to enable the main switching element 22 to perform a switching operation. The driver circuit 74 may be incorporated integrally into the PWM circuit 44.

The A/D converter 60 converts a current detection signal proportional to an output current Iout detected by a shunt resistor 16 from a analog to digital. The current detection signal from the A/D converter 60 is output to any one of the normal feedback control circuit 70 or the burst signal previous value correcting circuit 64 by means of the changeover switch 62. The burst signal from the burst signal generating circuit 46 is inputted into A duty ratio determination circuit 66. The duty ratio determination circuit 66 compares the duty ratio of the burst signal with a reference value preset. The duty ratio determination circuit 66 sends out a suitable changeover signal to the changeover switch 62 so that when the duty ratio of the burst signal does not exceed the reference value, the duty ratio determination circuit 66 connects the A/D converter 60 with the burst signal previous value correcting circuit 64, whereas when the duty ratio of the burst signal exceeds the reference value, the duty ratio determination circuit 66 connects the A/D converter 60 with the normal feedback control circuit 70. As a result, when the duty ratio of the burst signal is not larger than the reference value, a burst signal previous value correcting process is performed by the burst signal previous value correcting circuit 64, whereas when the duty ratio of the burst signal is larger than the reference value, the burst signal previous value correcting process is performed by the normal feedback control circuit 70 in the same way as was conventionally done. In addition, the changeover switch 62 may be provided at the anterior stage of an output circuit 72 to input into the output circuit 72 either of control value output from the normal feedback control circuit 70 or the burst signal previous value correcting circuit 64 and further the switching action of the changeover switch 62 may be performed not by a mechanical or electrical switch but by a branching process of a program or the like.

It suffices for the burst signal previous value correcting circuit 64 to import and store a digitalized current detection signal output from the A/D converter 60, and then store the control value output to the output circuit 72 to output a presently generated control value y using the last or the nth last (n>1) value of the current detection signal and the last or the nth last (n>1) control value. Accordingly, the burst signal previous value correcting circuit 64 is at least equipped with a storage unit 80 for storing the previous current detection signal V and the previous control value x, and a processing unit 82 for generating the presently generated control value y based on the previous current detection signal V and the previous control value x and inputting the presently generated control value y into the output circuit 72. In addition, if preserving the functions described above, the normal feedback circuit 70 and the burst signal previous value correcting circuit 64 may be incorporated integrally into the output circuit 72. The presently generated control value y generated by the processing unit 82 is detailed individually in the aftermentioned description of the behavior.

The load drive device according to the present embodiment is a light-emitting element drive device for an LED 10. Otherwise, however, the load drive device is applicable to a variety of loads with little or no abrupt load variation such as an electric lamp, an electric motor or the like. According to the present embodiment, by detecting a load current, that is, an output current of the LED 10, the detected value is obtained from the A/D converter 60. A different configuration for detecting a state of the load (e.g., an output voltage or the like), however, may be applicable. Here, the shunt resistor 16 is employed as a current detector. A current transformer, however, may be employed in substitute for the shunt resistor 16 in order to reduce resistive loss.

Next is a description of the behavior of the foregoing configuration. The behavior of the converter circuit 14 is entirely the same as the conventional one. Specifically, when the main switching element 22 turns on, an input voltage Vin is applied to the choke coil 20 to store electric energy in the choke coil 20. Then, when the main switching element 22 turns off, the electric energy stored in the choke coil 20 and the electric energy fed from the DC power supply 12 are sent out to the capacitor 26 on an output side through the diode 24, supplying an output voltage Vout higher than the input voltage Vin to the LED 10.

Then, when the dimming signal is externally applied, the analogue voltage level of the dimming signal is converted into a digital value by the A/D converter 68 and then the digital value is imported into the burst signal generating circuit 46. The higher the digitalized value from the A/D converter 68, the smaller the duty ratio of the digitalized burst signal is generated. If the duty ratio of the burst signal from the burst signal generating circuit 46 is so large as to go above a reference value, the duty ratio determination circuit 66 switches the changeover switch 62 so as to connect the A/D converter 60 with the normal feedback control circuit 70, allowing the feedback circuit 28 to perform the control through the normal feedback control circuit 70. On the other hand, if the duty ratio of the burst signal from the burst signal generating circuit 46 is so small as to go below the reference value, the duty ratio determination circuit 66 switches the changeover switch 62 so as to connect the A/D converter 60 with the burst signal previous value correcting circuit 64, allowing the feedback circuit 28 to perform the control through the burst signal previous value correcting circuit 64.

When performing the control at a normal state through the normal feedback control circuit 70, the current detection signal proportional to the output current Iout of the LED 10 detected by the shunt resistor 16 is compared with a reference voltage in the normal feedback circuit 70 and then an error amplified signal is sent out to the output circuit 72. Here, when the burst signal changes to an active state, the switch element 48 turns on to input the error amplified signal into the PWM circuit 44 through the phase compensating circuit 38. Hence, a pulse drive signal with the duty ratio corresponding to the voltage level of the error amplified signal is supplied to the main switching element 22, controlling switching operation of the main switching element 22 so as to flow a desired output current Iout through the LED 10.

On the contrary, when the duty ratio of the burst signal goes below the reference value and thus the control performed through the normal feedback control circuit 70 switches to the control performed through the burst signal previous value correcting circuit 64, then the processing unit 82 of the burst signal previous value correcting circuit 64 generates the presently generated control value y based on the result of comparison of the value V of the previous current detection signal (the previous current detection signal V) with the one or more thresholds TH, thereby sending out the presently generated control value y to the output circuit 72. Here, only when the burst signal is an active state, the presently generated control value y is output to the PWM circuit 44. Then, the pulse drive signal with the duty ratio depending on the presently generated control value y is supplied to the main switching element 22 so that a desired output current Iout continuously flows through the LED 10. At this time, the output current Iout is controlled based on the control value y generated by the burst signal previous value correcting circuit 64 and hence no decrease in the output current Iout.

Figures 2, 3:
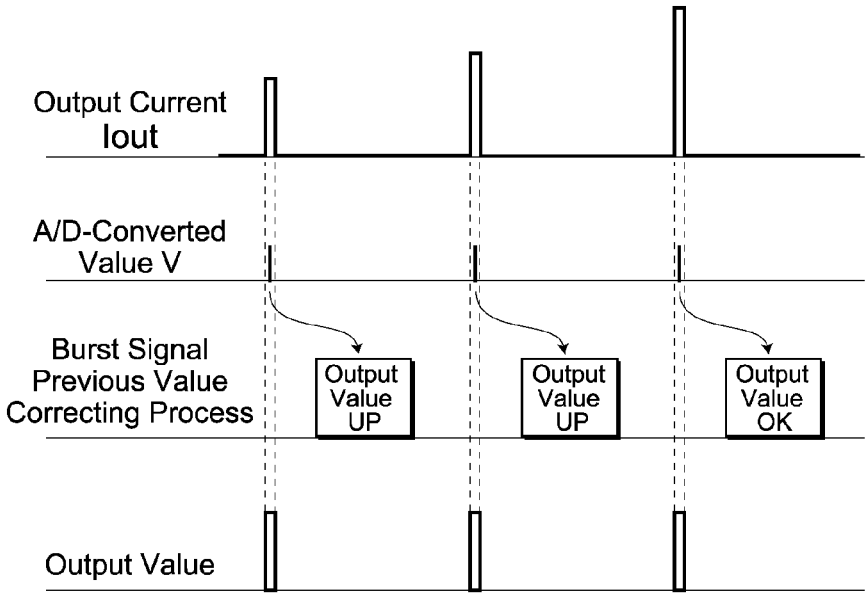
FIG. 2 is a timing chart showing a behavior of respective parts that are undergoing the processing by a burst signal previous value correcting circuit according to the embodiment of the present invention.
FIG. 3 is an explanatory figure showing calculation examples of a presently generated control value of the embodiment of the present invention.

FIG. 2 is a timing chart showing a signal in each part to explain processing by the burst signal previous value correcting circuit 64. Here, the output current Iout flows periodically in synchronization with the burst signal. A switching element not shown in FIG. 1 is connected between the LED 10 and the shunt resistor 16, and the switching element connected between the LED 10 and the shunt resistor 16 turns on only when the burst signal is an active state. Therefore, the output current Iout flows only when the burst signal is an active state. The burst signal previous value correcting circuit 64 corrects the previous control value x and outputs it as the presently generated control value y when the previous current detection signal V is not desired value (or is out of desired value range), whereas the burst signal previous value correcting circuit 64 outputs the previous control value x as the presently generated control value y when the previous current detection signal V is desired value (or is in desired value range). For example, the burst signal previous value correcting circuit 64 increases the previous control value x when the previous current detection signal V is smaller than the desired value, whereas the burst signal previous value correcting circuit 64 decreases the previous control value x when the previous current detection signal V is larger than the desired value.

Actually, the burst signal previous value correcting circuit 64 generates the presently generated control value y according to, e.g., processing formulae as shown in FIG. 3 to FIG. 6. In the processing examples shown in FIG. 3, the previous A/D-converted value V (the previous current detection signal V) is compared with a threshold TH1. When the previous A/D-converted value V is larger than the threshold TH1, a value obtained by subtracting 1 from the previous control value x is determined as a presently generated control value y. When the previous A/D-converted value V is equal to the threshold TH1, the previous control value x is determined directly as the presently generated control value y. When the previous A/D-converted value V is smaller than the threshold TH1, a value obtained by adding 1 to the previous control value x is determined as the presently generated control value y.

In the processing examples shown in FIG. 4, a processing condition is determined by the result of comparison of the previous A/D-converted value V with two thresholds TH2-1 and TH2-2 (TH2-1>TH2-2). Specifically, when the previous A/D-converted value V is not less than the first threshold TH2-1, a value obtained by subtracting 1 from the previous control value x is determined as a presently generated control value y. When the previous A/D-converted value V is smaller than the first threshold TH2-1 and is not less than the second threshold TH2-2, the previous control value x is determined directly as the presently generated control value y. When the previous A/D-converted value V is smaller than the second threshold TH2-2, a value obtained by adding 1 to the previous control value x is determined as the presently generated control value y. In this manner, the A/D-converted value V that allows the previous control value x directly to be the presently generated control value y is given a certain range and thereby the presently generated control value y can be prevented from frequently varying.

In the processing examples shown in FIG. 5, the result of comparison of the previous A/D-converted value V with four thresholds TH3-1, TH3-2, TH3-3 and TH3-4 (TH3-1>TH3-2>TH-3-3>TH3-4) is determined as a processing condition. Specifically, when the previous A/D-converted value V is not less than the first threshold TH3-1, a value obtained by subtracting 2 from the previous control value x is determined as a presently generated control value y. When the previous A/D-converted value V is smaller than the first threshold TH3-1 and besides is not less than the second threshold TH3-2, a value obtainted by subtracting 1 from the previous control value x is determined as the presently generated control value y. When the previous A/D-converted value V is smaller than the second threshold TH3-2 and besides is not less than the third threshold TH3-3, the previous control value x is determined directly (is allowed to remain unchanged to be determined) as the presently generated control value y. When the previous A/D-converted value V is smaller than the third threshold TH3-3 and besides is not less than the second threshold TH3-4, a value obtainted by adding 1 to the previous control value x is determined as the presently generated control value y. When the previous A/D-converted value V is less than the fourth threshold TH3-4, a value obtainted by adding 2 to the previous control value x is determined as the presently generated control value y. Thus, by increasing the number of the processing conditions, a presently generated control value y can be more finely regulated, thus enabling a more rapid approximation to a target value.

In all the processing examples shown in FIG. 3 to FIG. 5, only the previous control value x is utilized to generate the presently generated control value y. In processing examples shown in the following FIG. 6, however, the last control value x and the second last control value x−1, the last A/D-converted value V and the second last A/D-converted value V−1, and the target value TH4-3 are employed to calculate a presently generated control value y. Here, under the processing condition of the result of comparison of the previous A/D-converted value V with the two thresholds TH4-1, TH4-2 (TH4-1>TH4-2), a target value TH4-3 of the A/D-converted value is set between the thresholds TH4-1, TH4-2. Then, when the previous A/D-converted value V is not less than the first threshold TH4-1 or is smaller than the second threshold value TH4-2, a ratio is determined between the variation in the previous value of the control value calculated by subtracting the previous control value x from the second last control value x−1 and the variation in the previous value of the detected value calculated by subtracting the previous A/D-converted value V from the second last A/D-converted value V−1. Then, it is calculated how much correction value enables the previous A/D-converted value V to become equal to the target value TH4-3. Then, the correction value calculated is combined with the previous control value x to determine the combined value as a presently generated control value y. When the previous A/D-converted value V is smaller than the first threshold TH4-1 and is not less than the second threshold TH4-2, the previous control value x is allowed to remain unchanged to be determined as a presently generated control value y, thus permitting the presently generated control value y to be more finely regulated. In addition, in these calculation examples, as evidenced by the processing formulae in FIG. 6, when the previous A/D-converted value V is not less than the first threshold TH4-1, the correction value becomes negative, whereas when the previous A/D-converted value V is smaller than the second threshold TH4-2 the correction value becomes positive.

Figures 6, 7:
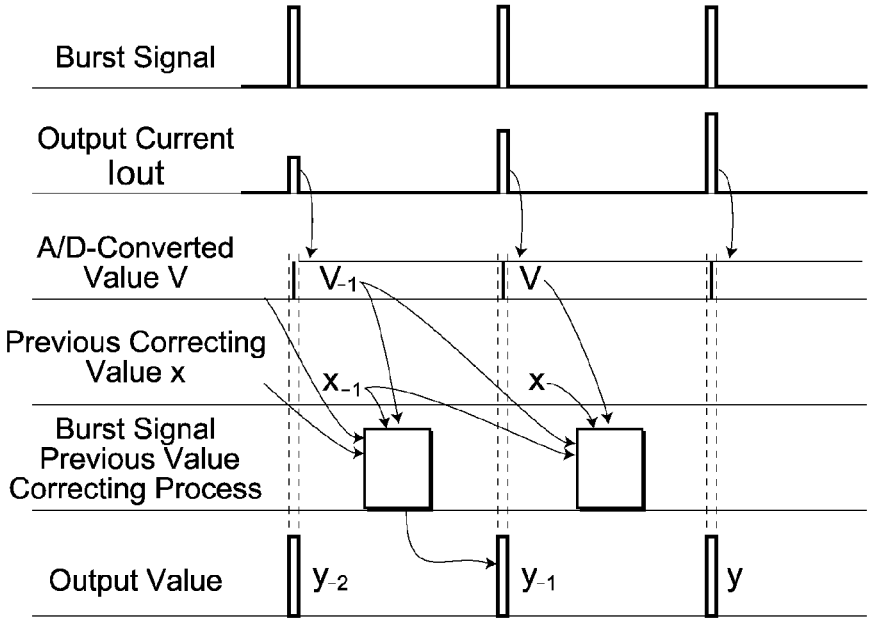
FIG. 6 is an explanatory figure showing further other calculation examples of the present controlling value of the embodiment of the present invention.
FIG. 7 is a timing chart showing behaviors of respective parts when the previous value correction process is carried out based on calculation examples in FIG. 6, according to the embodiment of the present invention.

FIG. 7 shows a timing chart of waveforms in each part when the burst signal previous value correcting process is performed based on the calculation examples in FIG. 6. Here, the previous A/D-converted value V and the second previous A/D-converted value V−1, the previous control value x and the second previous control value x−1, that are the previous values for correction, are read in by the calculator 82 to calculate a presently generated control value y. As a result, the output current Iout generated every cycle of the burst signal approximates gradually to a desired value.

In addition, the processing condition and the processing formulae which are shown in FIG. 3 to FIG. 6 are represented simply as a typical example of the previous burst signal value correcting process and therefore adjustable values applied to the previous control value x in each of the processing formulae, e.g., in FIG. 3 to FIG. 6 may be appropriately varied. Further, in each of the processing conditions in FIG. 3 to FIG. 6, not the previous A/D-converted value V but, e.g., the second previous A/D-converted value V−1 may be employed as the previous value of the detected value, otherwise an average value over the range of the nth last values (n>1) V, V−1, - - - may be calculated to employ the average value as the previous value of the detected value. Thus, the comparison of each of these values may be made with any one of the thresholds TH-1 to TH4. Further, similarly with the previous value of the control value, not the previous control value x but, e.g., the second previous control value x−1 is employed as the previous value of the control value and besides the average value over the range of the nth last values (n>1) x, x−1, - - - may be calculated to employ the average value as the previous value of the control value.

As described above, the light-emitting element drive device according to the present embodiment comprises the converter circuit 14 acting as an output circuit for supplying electric power to the LED 10, being a load; the feedback circuit 28 acting as an electric power control circuit which controls electric power by turning on or off the supply of the electric power to the LED 10 depending on the duty ratio of the burst signal that is externally and directly input or is generated by the burst signal generating circuit 46 to control the electric power, and besides generates the control value for controlling the LED 10 based on the A/D-converted value serving as a detected value obtained by detecting, e.g., the output current Iout, indicating the state of the LED 10 to send out the control value to the output circuit, when the supply of the electric power to the LED 10 is in an on-state; the burst signal previous value correcting circuit 64, acting as a previous value correcting circuit, for correcting a presently generated control value y, based on, as the previous values of the A/D-converted value V and control value x which are generated every cycle of the burst signal, e.g., the last A/D-converted value V, the second last A/D-converted value V−1, the last control value x, and the second last control value x−1; and the duty ratio determination circuit 66 for allowing the burst signal previous value correcting circuit 64 to operate upon determining that the duty ratio of the burst signal goes above or below the reference value.

In this fashion, when the duty ratio of the burst signal goes above or below the reference value to get, e.g., smaller than the reference value, the burst signal previous value correcting circuit 64 is allowed to operate, thereby making it possible to correct the presently generated control value to a value close to a value under steady-state condition in which the duty ratio of the burst signal does not go below the reference value, using the previous values of the detected value and the control value which occur every cycle of the burst signal. Consequently, the linearity at the time of gradually reducing the output electric power supplied to the LED 10 can be improved, enabling the range of the output electric power to be expanded.

Specifically, according to the calculation examples shown in FIG. 3 to FIG. 5, the burst signal previous value correcting circuit 64 increases or decreases the correction values (e.g., +2 to −2 in FIG. 5) combined with the previous control value x or the previous value of the control value, according to the result of comparison of the A/D-converted value V or the previous value of the detected value, with one or more threshold values TH2-1, TH2-2 and TH-3-1, TH3-2, TH3-3, TH3-4, to thereby generate the presently generated control value y.

As a result, there can be calculated the presently generated control value y that is output every cycle of the burst signal by increasing or decreasing the correction value to be combined with the previous control value x, according to the result of comparison of the previous A/D-converted value V with the one or more thresholds TH1, TH2-1, TH2-2, or the thresholds TH3-1, Th3-2, TH3-3, TH3-4.

Further, according to the calculation examples shown in FIG. 6, the burst signal previous value correcting circuit 64 determines the ratio of the variation between the previous control value x and the second last control value x−1 relative to the variation between the previous A/D-converted value V (or the previous value of the detected value) and the second last A/D-converted value V−1, then calculating the correction value by dividing the value, obtained by subtracting the previous A/D-converted value V from the target value TH4-3 corresponding to a desired output current Iout, by the ratio between the variations, followed by combining this correction value with the previous control value x to generate the presently generated control value y.

In this manner, there is obtained the ratio between the variation in the previous value of the control value obtained by subtracting the previous control value x from the second last control value x−1 and the variation in the previous value of the detected value obtained by subtracting the previous A/D-converted value V from the second last A/D-converted value V−1, followed by calculating the correction value based on the ratio in order that the previous A/D-converted value V may reach the target value TH4-3, and then combining the correction value thus obtained with the previous control value x to determine the presently generated control value y, thereby permitting the presently generated control value y to be more finely regulated.

Further, the burst signal previous value correcting circuit 64 according to the present embodiment comprises the storage unit for storing the previous current detection signal value V obtained by the feedback circuit 28 in synchronization with the burst signal and further storing the previous control value x output to the converter circuit 14, and the calculator 82 for calculating the corrected presently generated control value y by way of input of the previous value of current detection signal value V and the previous control value x which are read out of the storage unit 80, and then outputting the thus calculated value to the converter circuit 14.

Accordingly, the calculator 82 reads out the previous current detection signal value V and the previous control value x which are stored in advance in the storage unit 80, thereby enabling the control value y to be presently generated to be calculated as needs arise.

Furthermore, according to the present embodiment, there are provided the first A/D converter 68 for digitalizing a voltage of the burst signal and the second A/D converter 60 for digitalizing a voltage of the current detection signal, and then the burst signal previous value correcting circuit 64 imports these values produced by digitalizing burst signal and current detection signal to correct the presently generated control value y. Hence, both the burst signal and the current detection signal which are to be imported into the burst signal previous value correcting circuit 64 are digitalized, thereby enabling the process performed by the burst signal previous value correcting circuit 64 to be practical and easy.

Moreover, in this case, the first A/D converter 68 and the second A/D converter 60 are integrated into the burst signal previous value correcting circuit 64 to create an integrated unit, thus enabling a load drive device realized in a compact form to be provided.

Besides, the burst signal previous value correcting circuit 64 according to the present embodiment may import, as the previous value of the detected value, one detected value selected from among, e.g., the previous A/D-converted value V and the second last A/D-converted value V−1 which are obtained by the feedback circuit 28. Accordingly, one detected value obtained by the feedback circuit 28 is utilized as the previous value of the detected value, thereby enabling the control value y to be corrected by a simple process.

Alternatively, the burst signal previous value correcting circuit 64 according to the present embodiment may calculate an average value of a plurality of the detected values (the A/D-converted values V, V−1, - - - ranging over the nth last ones (n>1)) obtained by the feedback circuit 28 and then may import the average value as the previous value of the detected value. Accordingly, the average value of the plurality of the detected values obtained by the feedback circuit 28 is calculated to utilize the average value as the previous value of the detected value, thereby enabling the control value y to be precisely corrected.

Further, the burst signal previous value correcting circuit 64 according to the present embodiment may import, as the previous value of the control value, one control value selected from among, e.g., the previous control value x and the second last control value x−1 which are output to the converter circuit 14. Accordingly, one control value output to the converter 14 is utilized as the previous value of the control value, thereby enabling the control value y to be corrected by a simple process.

Alternatively, the burst signal previous value correcting circuit 64 according to the present embodiment may calculate an average value of a plurality of the control values (the control value x, x−1, - - - ranging over the nth last ones (n>1)) output to the converter 14 and then may import the average value as the previous value of the control value. Accordingly, the average value of the plurality of the control values output to the converter circuit 14 is calculated to utilize the average value as the previous value of the control value, thereby enabling the control value y to be precisely corrected.

In addition, the present invention is not limited to the present embodiment and various modifications are possible within the scope of the gist of the present invention. The configuration of the converter circuit 14 acting as an output circuit is not limited to a boost type one employed according to the present embodiment. A buck type one, a boost type one or the like, e.g., may be applicable as long as desired electric power can be supplied to the LED 10, being a load.

What is claimed is:

1. A load drive device comprising:

a converter circuit for controlling an electric power by performing PWM (Pulse Width Modulation) control, an output circuit for turning on or off the electric power supplied to a load according to a burst signal, a comparison circuit for comparing a duty cycle of said burst signal with a reference value, and a control value generating circuit for outputting a control value generated based on a detected value obtained by detecting a state of the load to said output circuit when said burst signal is active and said output circuit supplies the electric power if a duty ratio of said burst signal is not smaller than said reference value, and a previous value correcting circuit for outputting said control value obtained by correcting a previous value of said control value to said output circuit when said burst signal is active and said output circuit supplies the electric power if a duty ratio of said burst signal is smaller than said reference value, a PWM circuit for generating a pulse drive signal for operating said PWM control by inputting said control value from said output circuit, wherein said PWM circuit determines a duty cycle of PWM based on said control value output from said control value generating circuit or said previous value correcting circuit.

2. The load drive device according to claim 1, wherein said previous value correcting circuit increases or decreases the previous value of said control value according to a result of comparison between the previous value of said detected value and one threshold to generate a presently generated control value.

3. The load drive device according to claim 2, further comprising:

a storage unit for storing said detected value and said control value, wherein said previous value correcting circuit accesses said storage unit.

4. The load drive device according to claim 1, wherein said previous value correcting circuit increases or decreases the previous value of said control value according to a result of comparison between the previous value of said detected value and a plurality of thresholds to generate a presently generated control value.

5. The load drive device according to claim 4, further comprising:

a storage unit for storing said detected value and said control value, wherein said previous value correcting circuit accesses said storage unit.

6. The load drive device according to claim 5, further comprising:

a first A/D converter for digitalizing said detected value, wherein said control value generating circuit and said previous value correcting circuit utilize a value produced by digitalizing said detected value.

7. The load drive device according to claim 1, further comprising: a first A/D converter for digitalizing said detected value, wherein said control value generating circuit and said previous value correcting circuit utilize a value produced by digitalizing said detected value.

8. The load drive device according to claim 7, wherein said control value generating circuit generates said control value of a digital value utilizing said detected value of a digital value.

9. The load drive device according to claim 1, wherein said previous value correcting circuit determines a ratio between a variation in the previous value of said control value and a variation in the previous value of said detected value and calculates a correction value by dividing a value, obtained by subtracting the previous value of said detected value from a target value, by said ratio, and then combines said correction value with the previous value of said control value to generate a presently generated control value.

10. The load drive device according to claim 9, further comprising:

a storage unit for storing said detected value and said control value, wherein said previous value correcting circuit calculates said correction value based on a plurality of said detected values and a plurality of said control values which are stored in said storage unit.

11. The load drive device according to claim 1, wherein said previous value correcting circuit calculates an average value of a plurality of detected values obtained by detecting a state of the load to utilize said average value as the previous value of said detected value.

12. The load drive device according to claim 1, wherein said previous value correcting circuit calculates an average value of a plurality of control values output to said converter circuit to utilize said average value as the previous value of said control value.

* * * * *